United States Patent [19]

Hurst

[11] 4,058,063

[45] Nov. 15, 1977

[54] SHAPED CHARGE ROD WARHEAD

[75] Inventor: William M. Hurst, Socorro, N. Mex.

[73] Assignee: The Unites States of America as represented by the Secretary of the Navy, Washington, D.C.

[21] Appl. No.: 777,213

[22] Filed: Nov. 18, 1968

[51] Int. Cl.[2] ..... F42B 13/10

[52] U.S. Cl. ..... 102/56 SC; 102/67

[58] Field of Search ..... 102/24 HC, 22, 67, 56

[56] References Cited

U.S. PATENT DOCUMENTS

| | | | |
|---|---|---|---|
| 3,212,437 | 10/1965 | Saling | 102/22 |
| 3,224,372 | 12/1965 | Nooker | 102/67 |
| 3,228,336 | 1/1966 | Kempton | 102/67 |

*Primary Examiner*—Charles T. Jordan

*Attorney, Agent, or Firm*—R. Sciascia; R. Beers; S. Sheinbein

[57] ABSTRACT

A warhead containing an hourglass-shaped explosive charge. At either or both ends of the charge an expandable rod structure or rod fragments are placed and arranged at any desired angle to the longitudinal axis of the charge. The charge is initiated at the center of its length and because of its shape creates a concentrated pancake configured shock wave and gas cloud expanding radially outward from the center of the missile. Because of the large amount of explosive between the initiation point and the rod structure the rods are imparted with a higher velocity than in conventional rod warheads of comparable mass.

3 Claims, 4 Drawing Figures

INVENTOR
WILLIAM M. HURST

BY

ATTORNEY

SHAPED CHARGE ROD WARHEAD

STATEMENT OF GOVERNMENT INTEREST

The invention defined herein may be manufactured and used by or for the Government of the United States of America for governmental purposes without the payment of any royalties thereon or therefor.

BACKGROUND OF THE INVENTION

The present invention relates generally to improvements in warheads and more particularly it pertains to new and improved warheads wherein the shape of the explosive charge directs the explosive energy along a destructive path and also imparts great velocities to expanding rod structure which travel along different destructive paths.

Prior rod warheads have had a generally cylindrical explosive charge surrounded by a tubular structure of parallel rods welded together at their alternate opposite ends. Upon initiation of the explosive the rod structure is forced outward and expands into a ring of end to end rods. Another prior arrangement is disclosed in U.S. Pat. No. 3,224,372 to Nooker wherein a plurality of expanding rod structures tilted relative to one another have been provided. Upon detonation of the charge each rod structure is sent along a different destructive path to increase the "kill" probability or probability that the warhead will destroy the target. The amount by which the Nooker warhead will increase the kill probability depends upon the number of rod structures that the warhead carries. Since each rod structure adds weight to the warhead it can be seen that it would be advantageous if the high kill probability attained with a plurality of rod structures could be maintained while some of the rod structures were eliminated.

In addition to increasing the number of expanding rod structures, the kill probability of a rod warhead can be increased by increasing the speed with which the rod structures expand. This is because experiments have shown that a rapidly expanding rod structure has a greater probability of hitting the target, and further because, once it hits the target, a rapidly expanding rod structure will do more damage than one which is expanding more slowly.

It has also been known in the prior art (U.S. Pat. No. 3,233,688 to Bell) to provide a charge shaped to focus the energy of its explosion along a particular destructive path. Applicant has combined the concept of prior art rod warheads and the concept of prior shaped charge explosives in an unobvious manner to provide a relatively light warhead having an increased probability of kill.

SUMMARY OF THE INVENTION

The general purpose of this invention is to provide a warhead having an increased probability of kill as in an equivalent warhead of the type disclosed by Nooker but being lighter than an equivalent Nooker warhead because at least one of the expanding rod structures is eliminated and replaced with a pancake configured shock wave and gas cloud created by initiation of an hourglass-shaped explosive charge. The probability of kill is further increased because applicant's rod structures expand at a much faster rate than do rod structures in prior art rod warheads, since applicant's rod structures are positioned so that there is a large amount of explosive between the point of initiation and the rod structures.

OBJECTS OF THE INVENTION

An object of the present invention is the provision of a warhead having the destructive effects of the explosion channeled along a plurality of paths to increase the kill probability of the warhead.

Another object is to provide a warhead which will focus part of its explosive energy in a particular plane and at the same time impart extremely high velocities to expanding rod structures.

BRIEF DESCRIPTION OF DRAWINGS

Other objects and features of the invention will become apparent to those skilled in the art as the disclosure is made in the following description of the invention as illustrated in the accompanying sheet of drawings in which.

DETAILED DESCRIPTION OF THE PREFERRED EMBODIMENT

Figure 1:
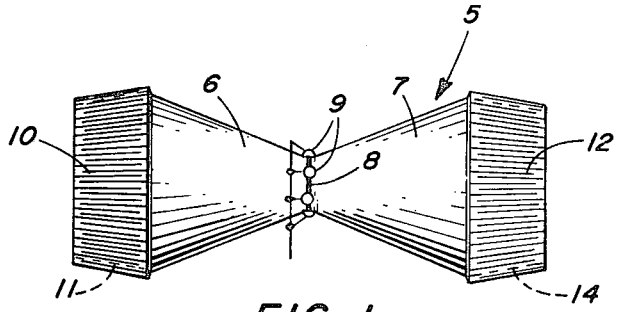
FIG. 1 is a side view of a preferred embodiment of the warhead of this invention.

FIG. 1 shows a preferred embodiment of a warhead 5 which contains an explosive charge made up of two frusto-conical sections 6 and 7 joined together at their smaller ends at 8, the longitudinal center of the warhead. Also at the center of the warhead are suitable initiating means such as boosters 9. An alternative initiating arrangement would be to provide a single booster within a void at the center of the warhead. At the ends of frusto-conical portions 6 and 7 are explosive segments 11 and 14, respectively, having expanding rod structures 10 and 12 mounted thereon. The warhead is enclosed in a suitable casing (not shown).

Figure 2:
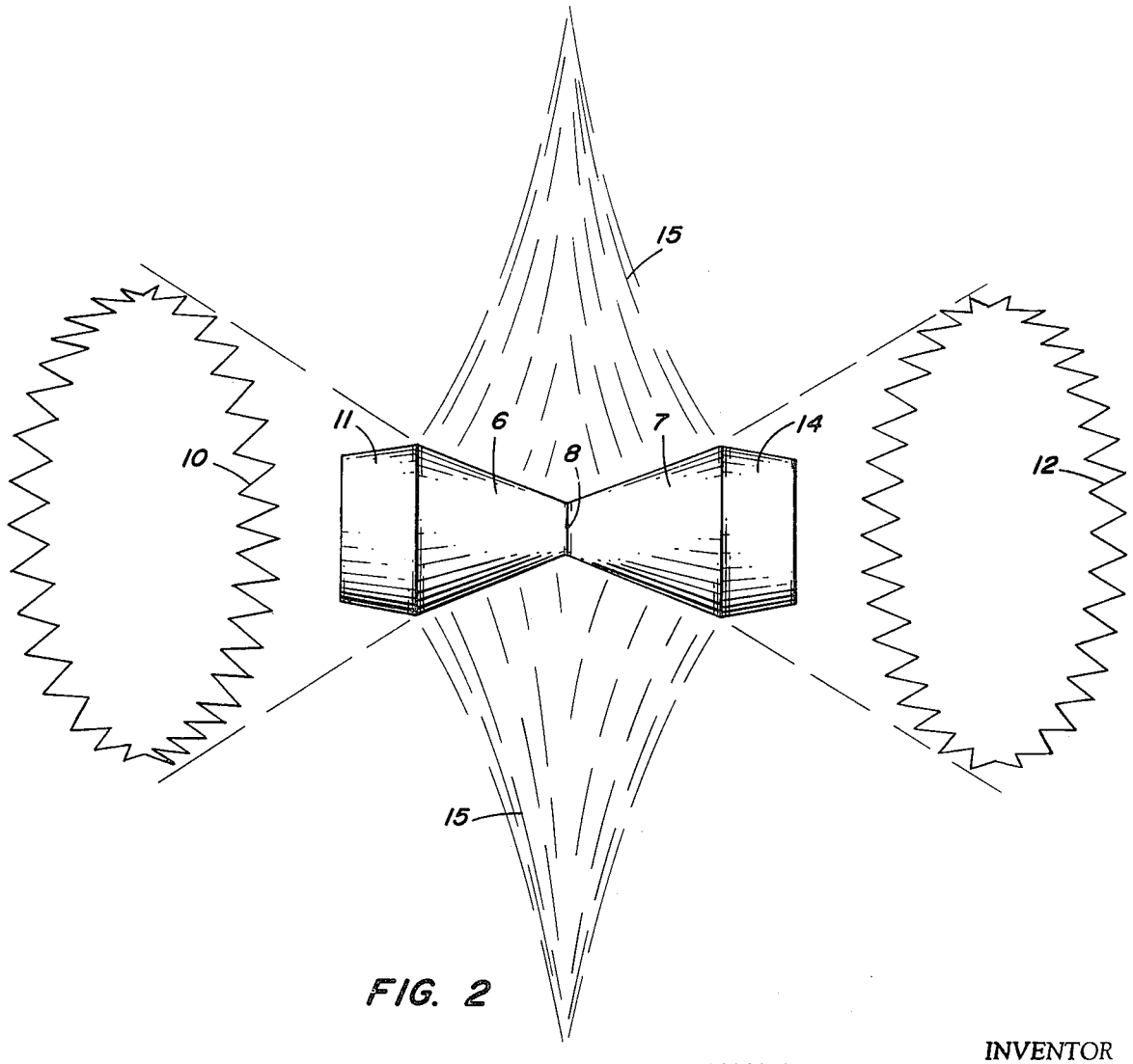
FIG. 2 is a schematic side view of the preferred embodiment showing the focused pancake-like explosion and the expanding rod structures.
Figure 3:
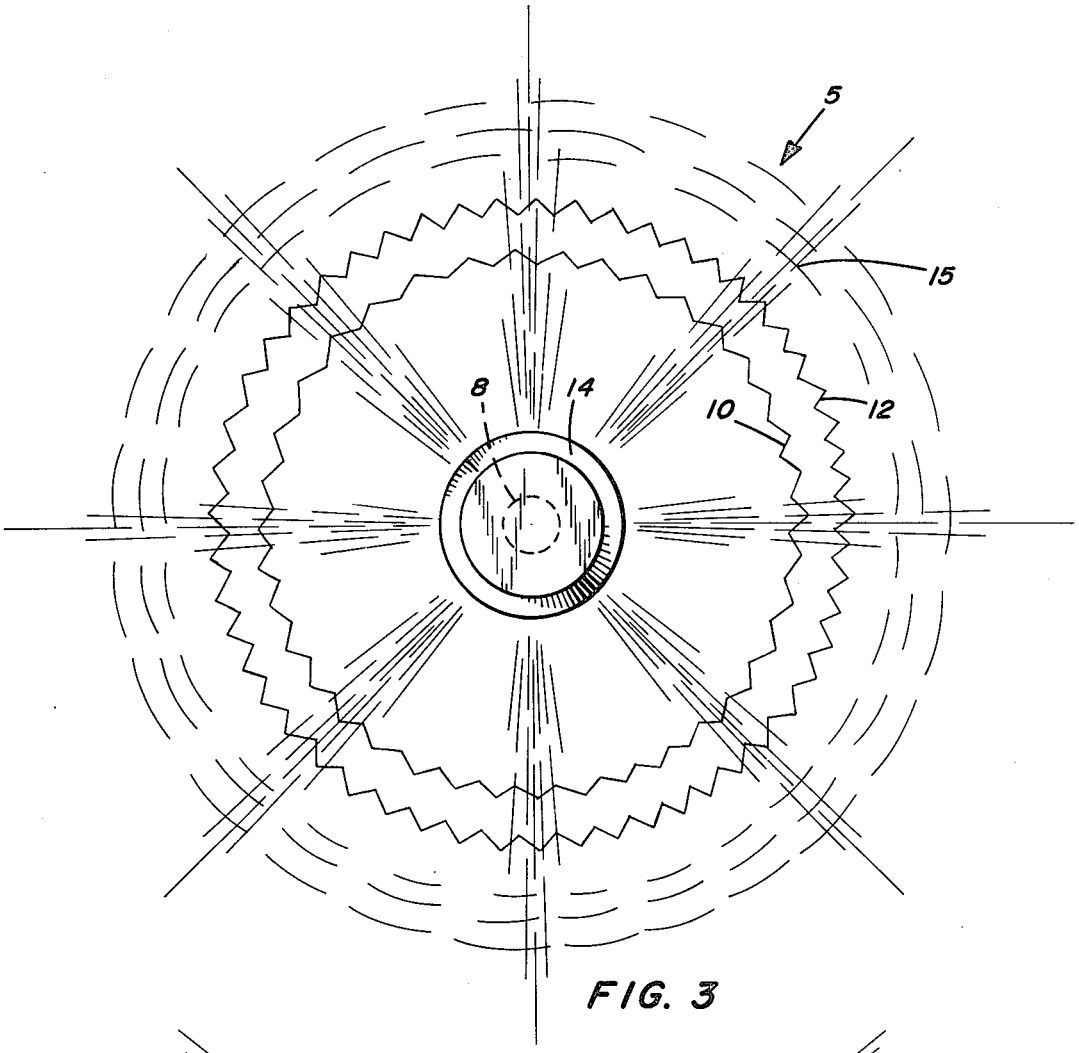
FIG. 3 is a schematic end view of the warhead showing the focused explosion and the expanding rod structures.

As can be seen in FIGS. 2 and 3, upon detonation of the warhead at its center 8 a detonation front travels outward through sections 6 and 7 and because of the shape of sections 6 and 7 a radially expanding pancake configured shock wave and gas cloud 15 is formed. Because the detonation front first travels through portions 6 and 7, by the time it reaches portions 11 and 14 it is very powerful. Therefore, the explosive force imparted to rod structures 10 and 12 is much greater than in conventional warheads in which the detonation front travels through only the radial thickness of explosive before imparting explosive force to the rod structure. This greater explosive force makes rod structures 10 and 12 expand more rapidly thus having greater probability of hitting the target and doing greater damage when they hit the target. The direction in which rod structures 10 and 12 expand can be controlled by varying the angle of portions 11 and 14 relative to the longitudinal axis of the warhead. Thus applicant provides a warhead lighter than that disclosed by the Nooker patent because focused explosion 15 takes the place of one of the heavy rod structures. In addition applicant's arrangement provides the advantage of much faster rod expansion than in prior art warheads.

DESCRIPTION OF THE ALTERNATE EMBODIMENT

Figure 4:
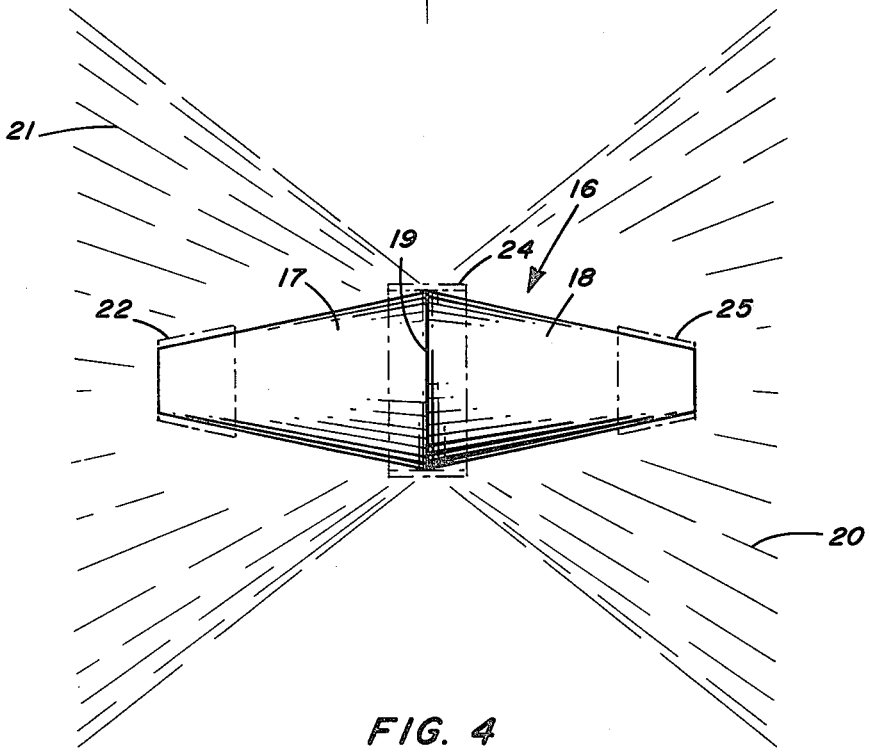
FIG. 4 is a side view of an alternate embodiment of the invention.

FIG. 4 shows an alternative embodiment of the invention in which warhead 16 is made up of two frusto-conical charges 17 and 18 joined at their large ends at 19, the longitudinal center of the warhead. Expanding ring structures may be provided at the ends of the warhead 22, 25 or at the center 24. The warhead is initiated at its center portion 19 and as the detonation front travels through portions 17 and 18 expanding dish-shaped shock waves and gas clouds 20 and 21 are formed. If a rod structure is provided at the center of the warhead 24 it will impart it with only the velocity of a normal warhead. However, rod structures 22 and 25 provided at the ends of the warhead will expand with much greater velocity than normal rod warheads because the detonation front will have gathered force while traveling through portions 17 and 18.

It would be possible to eliminate the expanding rod structures entirely and replace them with focused explosions. For example, in the preferred embodiment of FIGS. 1 and 2, rod structures 10 and 12 could be eliminated and sloping portions 11 and 14 extended so that they would produce wave forms like those shown in the embodiment of FIG. 4. Another alternative would be to replace the expanding ring structures with unconnected destructive fragments which would be propelled outward by the explosion.

Obviously many other modifications and variations of the present invention are possible in light of the above teachings.

What is claimed is:

1. A warhead comprising:

an elongated explosive charge having portions diverging from the longitudinal center of said charge and converging portions adjacent the longitudinal ends of said diverging portions;

means for initiating said explosive charge at a position along its length;

at least one expanding rod structure mounted on each of said converging portions substantially spaced from said initiating means;

the diverging portions of said explosive charge between said initiating means and said rod structures being shaped so that as a detonation front travels from said initiating means toward said rod structures the explosive energy of said portions is substantially focused in a desired plane.

2. A warhead according to claim 1 wherein:

said means for initiating said explosive charge is at the center of its length;

there are two expanding rod structures, one at each end of said charge; and the portion of explosive between said initiating means and each expanding rod structure is frusto-conical in shape.

3. The warhead of claim 1 wherein each rod structure is inclined at any desired angle to the longitudinal axis of said elongated charge.

* * * * *